US006128944A

United States Patent [19]

Haynes

[11] Patent Number: 6,128,944

[45] Date of Patent: Oct. 10, 2000

[54] APPARATUS FOR BENDING MALLEABLE METAL RODS

[76] Inventor: Alvin Haynes, 7033 Netherbrae Road, Unit #22, Miss, Ontario, Canada, L4T 2W2

[21] Appl. No.: 09/286,452

[22] Filed: Apr. 6, 1999

[51] Int. Cl.[7] ..... B21L 1/06; B21D 7/02

[52] U.S. Cl. ..... 72/458; 72/387; 72/479

[58] Field of Search ..... 72/387, 388, 458, 72/479; 140/92.1

[56] References Cited

U.S. PATENT DOCUMENTS

| | | | |
|---|---|---|---|
| 654,373 | 7/1900 | Wikstrom | 72/387 |
| 1,042,112 | 10/1912 | Hartman | 72/458 |
| 2,414,387 | 1/1947 | O'Neil | 72/387 |
| 2,907,368 | 10/1959 | Barnes | 72/92.1 |
| 3,808,867 | 5/1974 | Becker . | |
| 3,874,165 | 4/1975 | Dawson | 72/458 |
| 4,292,834 | 10/1981 | Tishler . | |
| 4,561,279 | 12/1985 | Wears . | |
| 4,788,847 | 12/1988 | Steghos . | |
| 5,271,260 | 12/1993 | Oetlinger | 72/388 |
| 5,490,409 | 2/1996 | Weber . | |
| 5,632,086 | 5/1997 | Helwig | 29/896.43 |
| 5,878,788 | 3/1999 | Gurry | 140/92.1 |

*Primary Examiner*—David Jones

*Attorney, Agent, or Firm*—Marks & Clerk

[57] ABSTRACT

An apparatus for bending malleable metal rods comprises a base plate having a plurality of holes arranged in rows and columns; a locking cam member having an ovoid configuration, with a camming surface at its broad end and a locking cam member pivot axis near its narrow end; and a a force application member. Each of the locking cam member and the force application member has a handle member; and each is adapted so as to be removably and pivotally mounted on the base plate, with their respective pivot axes each being aligned with one of the plurality of holes. At least two pins are adapted to be received in any two of the plurality of holes. A workpiece of malleable metal rod may be locked in place by being forced against two pins when they are received in two spaced apart holes, and the camming surface of the locking cam member is forced against the side of the workpiece remote from the side which contacts the two spaced apart pins. The workpiece is bent by contacting it with a force applying surface of the force application member at a region of the workpiece near one of the two spaced apart pins, which region is remote from the other of the spaced apart pins, and by causing pivotal movement of the force application member about its pivot axis by manipulation of its handle member, so as to transfer bending force from the force application member to the workpiece through the force applying surface.

20 Claims, 2 Drawing Sheets

APPARATUS FOR BENDING MALLEABLE METAL RODS

FIELD OF THE INVENTION

This invention relates to rod bending apparatus. More particularly, this invention relates to a portable and manually operated apparatus for bending malleable metal rods.

BACKGROUND OF THE INVENTION

There are many different circumstances where it is desired to bend a malleable metal rod. Several examples include the bending of wrought iron rod for constructing railings, fences, grates, and the like, and the bending of reinforcing bar—commonly known as rebar—used in poured concrete structures. Other examples may include the requirement to bend steel bar or rod which is used to support or suspend structures, false ceilings, display signs, and so on. In all of these circumstances—and many others—it is very often desirable to bend the malleable metal rod at the actual job site. Moreover, even when working in a shop, such as a shop which provides wrought iron structures, the requirements for bending each individual piece of wrought iron rod may be different, thereby necessitating a different set up for the malleable metal rod being bent at any instant in time.

It is also quite important that the malleable metal rod which is being bent may be bent through more than 90°. This criterion, however, is very often not met in the prior art, discussed hereafter.

Other circumstances where rod bending may be required at the job site, with very particular accuracy, is in surgical operating rooms where orthopaedic surgery is being conducted. Very often, there may be the necessity to bend surgical steel rod with complicated configurations, having specific dimensions, and with significant time constraints—especially considering that, at any instant in time, the patient may already have been anaesthetized.

In any of those circumstances which are suggested above, a manually operated apparatus for bending malleable metal rods may serve the purposes required very easily. The advantages may include the fact that an apparatus which is intended to be manually operated is less expensive in terms of its capital acquisition, and it is does not require additional sources of power such as electricity or hydraulic power. Moreover, portability of such an apparatus is most often required so that it may be moved from job site to job site, or from one work area to another on a very large job site.

The present invention provides such an apparatus which is portable and which is manually operated. The apparatus of the present invention may be easily manipulated to bend malleable metal rods with very complicated configurations. Moreover, it is very simple and quick to learn how to operate the apparatus of the present invention, so that any reasonably skilled worker may be trained to operate the apparatus of the present invention in a short period of time.

Other typical malleable metal rod materials which are particularly adapted for use with the present apparatus, apart from rebar, wrought iron, or surgical steel rod, include ordinary mild steel rod, brass rod, aluminum rod, copper rod, and so on. Such rods are usually round or rectangular in cross-section; rectangular rod is usually square in cross-section. Obviously, especially since the present invention is directed to a manually operated device, bar stock or rod stock made from such materials as case-hardened steel is not suitable to be bent using the apparatus of the present invention. Indeed, such materials are usually bent before they are case-hardened; in which case, they can be bent using the apparatus of the present invention.

DESCRIPTION OF THE PRIOR ART

BECKER U.S. Pat. No. 3,808,867 teaches a portable rod or true bender. An adjustable cam lock is used to hold the rod stock in place; and the rod stock is bent around a contoured die to a predetermined angle. The bending of the rod stock is accomplished by a force application member which uses a cylindrical bending die rotatably mounted so as to lessen the friction between the die and the rod stock. The apparatus is manually operated, and the handle of the force application member pushes the cylindrical die against the rod stock, bending it around the contoured die. The bending assembly is capable of bending angles up to 90°, but not more. If closely spaced bends are to be imparted to the rod stock, they must be sufficiently spaced apart, however, to accommodate the locking mechanism.

TISHLER et al U.S. Pat. No. 4,292,834 teaches a bending apparatus which will impart an irregular shape to a rod. The apparatus is also manually operated, and employs a series of traversing guide members which extend between two support members. The traversing guide members having longitudinal guideways formed therein; and each guideway has a plurality of threaded nuts that are slidably disposed within the guideways. These threaded nuts may be positioned in any desired position, in order to achieve the desired bended shape of the rod. The rod stock is clamped in place, and a length of tubular pipe is loosely telescoped over the end of the rod stock which is remote from the place where it is clamped. The tubular pipe is utilized as a handle, in order to successively bend the rod stock around the threaded fasteners on the longitudinal guideways.

U.S. Pat. No. 4,561,279 issued to WEARS teaches an apparatus that may be employed for rod bending and cutting. The bending portion of the apparatus is controlled by an hydraulic cylinder which effectively moves a crank arm assembly. The rod stock is clamped in place, and is disposed between two cylindrical members, one of which is rotatably mounted. The rotatable member is used to bend the rod, by being driven by the hydraulic cylinder so as to effectively move a crank arm assembly, thereby bending the rod around the fixed cylinder member. A maximum bend of 95° is permitted.

U.S. Pat. No. 4,788,847 issued to STERGHOS teaches the combination of a moveable mandrel and two moving rollers, between which the rod bending is effected. The rollers may be positioned in a series of predrilled holes in two support arms, each of which is rotatable about a fulcrum, where the predrilled holes accommodate the rotation of the rollers within. The rod stock is positioned between the mandrel and the rollers. The movement of the mandrel will cause a simultaneous movement of the arms such that the rod bends about the mandrel. A maximum bend of 180° is permitted. However, the radius of the bend is dependent upon the size of the mandrel which is used.

Finally, U.S. Pat. No. 5,490,409 issued to WEBER teaches a cam action rod bender for bending surgical steel rod. A knee lever configuration is employed, to bend the rod about a bending knob or mandrel, employing two fulcrums which are associated with a pair of handles which pivot about an axis which is also the axis of the bending knob.

SUMMARY OF THE INVENTION

In accordance with one aspect of the present invention, there is provided an apparatus for bending malleable metal rods. The apparatus comprises a base plate having a plurality of holes formed therein, the holes being arranged in rows and columns. There is a locking cam member having an ovoid configuration, with a narrow end and broad end. The locking cam member has a camming surface at its broad end, and a locking cam member pivot axis near the narrow end. The locking cam member is adapted so as to be removably and pivotally mounted on the base plate, with the locking cam member pivot axis being aligned with one of the plurality of holes.

There is also a force application member having a narrow end and a broad end, and the force application member has at least one force applying surface at one side of the broad end thereof. A force application member pivot axis is located near the narrow end ofthe force application member. Thus, the force application member is also adapted so as to be removably and pivotally mounted on the base plate, with its pivot axis being aligned with one of the plurality of holes.

At least two pins are provided, the pins being adapted to be received in any two of the plurality of holes.

Each of the locking cam member and the force application member has a handle member for effecting pivotal movement of each respective member about its respective pivot axis.

Thus, a workpiece of malleable metal rod may be located in place by being forced against two pins when they are received in two spaced apart holes, and when the camming surface of the locking cam member is forced against the side of the workpiece which is remote from the side thereof which contacts the two spaced apart pins. Further, the workpiece may be bent by contacting it with the force applying surface of the force application member at a region of the workpiece which is near one of the two spaced apart pins, but which is remote from the other of the spaced apart pins. By causing pivotal movement of the force application member about its respective pivot axis by manipulation of the handle member, bending force is transferred from the force application member to the workpiece through the force applying surface.

The pins which are employed in the present invention may have different configurations. They may have a constant diameter throughout their length, where the constant diameter is substantially equal to the diameter of each of the plurality of holes. Otherwise, the pins may have a diameter at one end which is substantially equal to the diameter of each of the plurality of holes, and a second selected diameter at the other end which is greater than the diameter of each of the plurality of holes. It may also be that the second selected diameter is less than the diameter of each of the plurality of holes.

Typically, each of the locking cam member and the force application member is pivotally mounted on the base plate by a respective pin which is adapted to be received by any one of the plurality of holes.

More especially, a pivot axis hole is generally formed in each of the locking cam member and the force application member in the region of the respective pivot axis of each such member, so that a respective further pin may be supplied for each of the locking cam member and the force application member, whereby that further pin may be received in any one of the plurality of holes on the base plate and in the respective pivot axis hole of the locking cam member or the force application member.

Generally, there is a force applying surface located at each side of the broad end of the force application member. Moreover, there may be a cylindrical force transfer member which is rotatably mounted at each side of the broad end of the force application member; in which case, the cylindrical force transfer member will comprise the respective force applying surfaces of the force application member.

In a particular embodiment of the present invention, each of the cylindrical force transfer members is rotatably mounted on a respective friction bearing member.

The locking cam member may have a polygonal hole formed therein to receive a mating polygonal pin member. That mating polygonal pin member is mounted on the handle member for the locking cam member, so that the handle member may be separated from the locking cam member.

Typically, each of the pins which is used in keeping with the present invention is casehardened steel. Quite considerable force may be placed against those pins, as described hereafter, and when they are formed of case-hardened steel, they have little tendency to bend.

The present invention also provides a method of bending a workpiece which comprises a malleable metal rod, using the apparatus hereof. The method comprises the steps of:

(a) Locking the workpiece in place on the base plate by placing two pins in spaced apart holes. Then the workpiece is placed against the two pins, and the locking cam member is placed at the side of the workpiece which is remote from the two spaced apart pins. Thereafter, the handle of the locking cam member is manipulated so as to force the camming surface thereof against the workpiece, and so as to force the workpiece against the two spaced apart pins. Thus, the workpiece is thereby locked in place.

(b) The force application member is placed on the base plate so that the force applying surface thereby contacts the workpiece in a region thereof near one of the two spaced apart pins and at the side thereof which is remote from the other of the spaced apart pins.

(c) Then, the force application member is pivotally moved about its respective pivot axis by manipulation of the handle member, so as to transfer bending force from the force application member to the workpiece through the force applying surface of the force application member.

Typically, steps (b) and (c) may be repeated more than once, with the force application member being placed at different locations on the base plate for each iteration of steps (b) and (c).

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Figure 2:
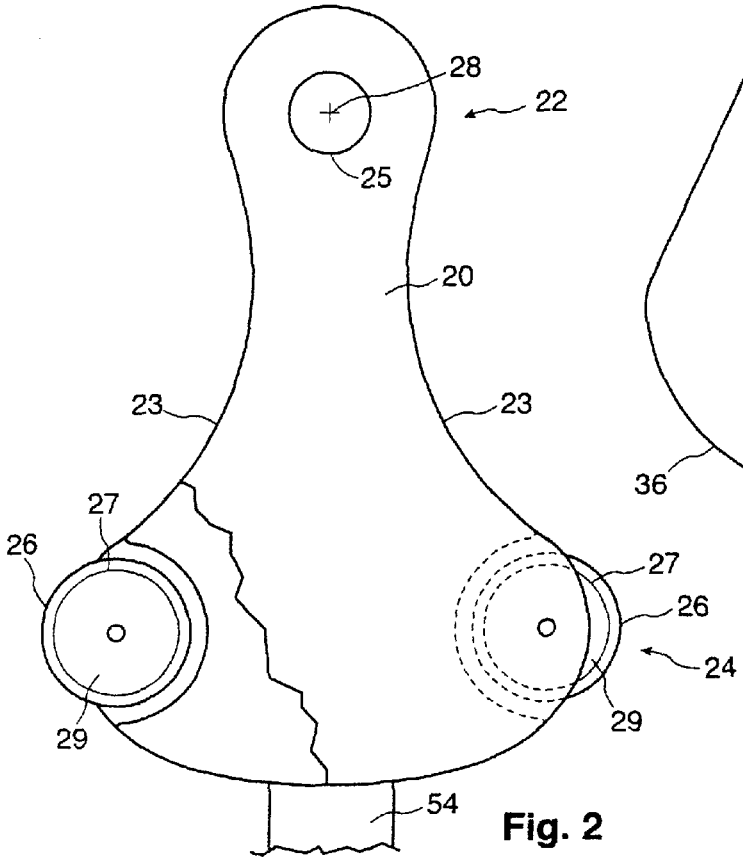
FIG. 2 shows a typical configuration of a force application member, in keeping with the present invention.
Figure 3:
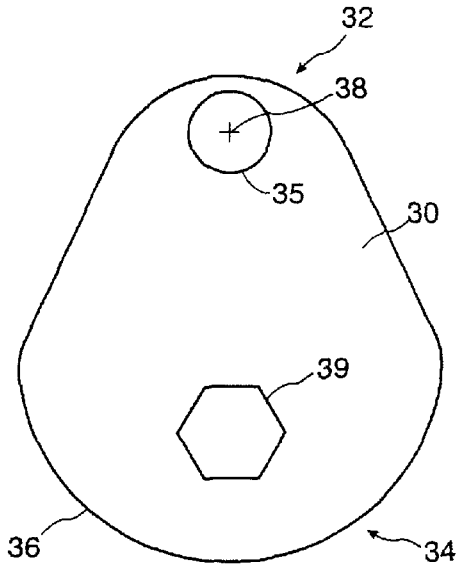
FIG. 3 shows a typical configuration of a locking cam member, in keeping with the present invention.
Figure 4:
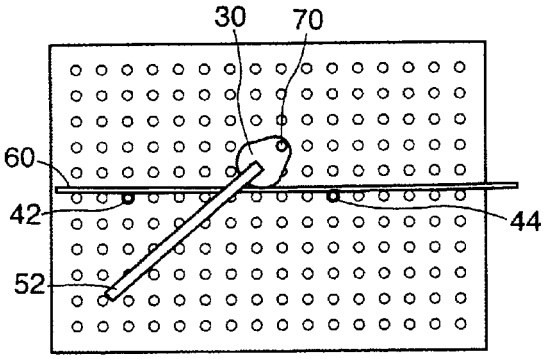
FIGS. 4 through 11 show successive steps which are taken in the bending of a rod member, using the apparatus and in keeping with the method of the present invention.

The apparatus of the present invention, in its totality, is shown in each of FIGS. 5 through 11. There are a number of distinct components which comprise the invention, the principal ones of which are shown in FIGS. 1 through 3.

Figure 1:
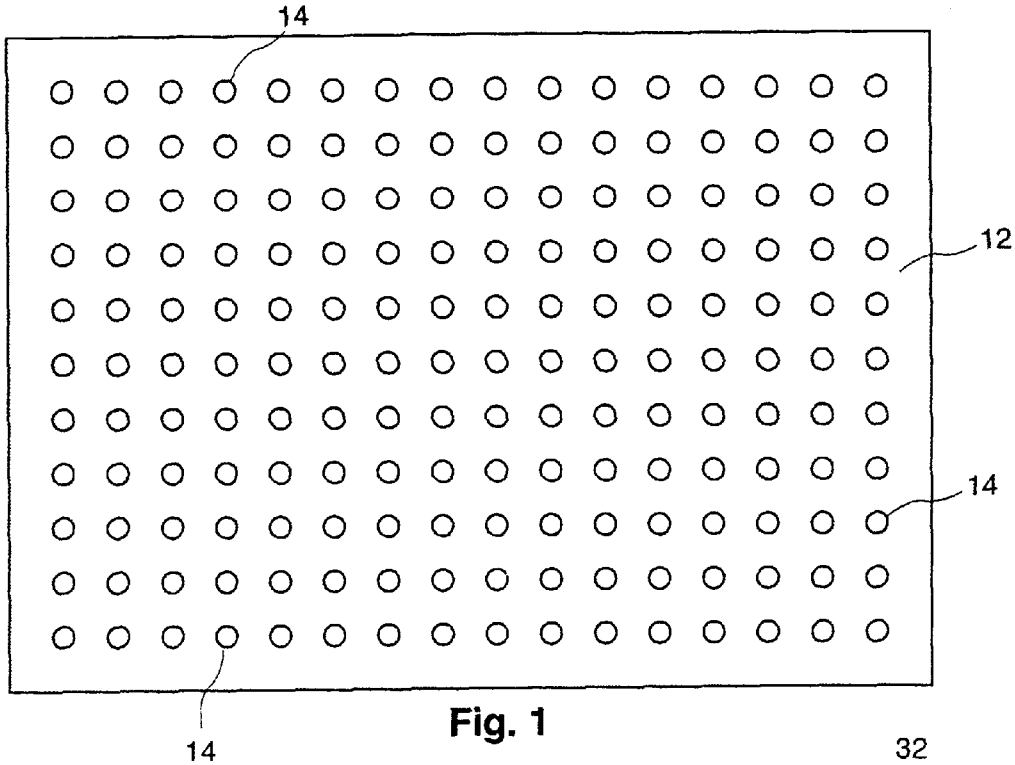
FIG. 1 shows a typical configuration of a base plate, in keeping with the present invention.

The first component to be described is the base plate 12, shown in FIG. 1. A plurality of holes 14 are formed in the base plate 12, and they are arranged in rows and columns as illustrated in FIG. 1. The exact number of rows and columns of holes, and the dimension of the holes (both in terms of their depth and their diameter), may vary from embodiment to embodiment of the apparatus in keeping with the present invention. Typically, there are ten to fifteen rows of holes, and fifteen to twenty columns of holes, so as to provide sufficient adaptability for the apparatus as it is used to bend malleable metal rods, and as described hereafter. The spacing between the holes in any row and/or column may typically be between two centimeters to four centimeters; it is not necessary that the spacing between rows be identical to the spacing between columns, but it is usual.

Typically, the diameter of each of the holes 14 is in the range of four to eight millimeters; and, typically, the depth of each hole 14 is in the range of 1.5 centimeters to three centimeters.

In general, the base plate 12 is rectangular in shape, but it may be square. Typically, the short dimension in the plane view of a base plate in keeping with the present invention is between twenty centimeters and fifty centimeters; the long dimension is between thirty centimeters and eighty centimeters. The base plate of the present invention may conveniently be formed of aluminum plate having a thickness of 2.5 centimeters to four centimeters. Other materials, such as steel plate, may be employed; however, the weight of a base plate formed of steel becomes formidable, especially when it is considered that it is intended that the apparatus of the present invention be reasonably portable so that it may be carried from one place to another.

The next major component of the apparatus of the present invention is the force application member 20, which is shown in FIG. 2. The shape of the force application member is such that it has a narrow end at 22, and a broad end at 24. There is at least one force applying surface 26 at one side of the broad end of the force application member 20. Typically, however, there are two force application surfaces 26, one at each side, because the force application member 20 may be mounted on the base plate generally in either face-up or face-down orientation, and it may be also mounted so as to operate in a clockwise or a counter-clockwise pivotal motion, all as described hereafter.

The force application member has a pivot axis 28 which is located near the narrow end 22. As will be described in greater detail hereafter, the force application member 20 is adapted so as to be removably and pivotally mounted on the base plate 12, with the force application member pivot axis 28 being aligned with one of the plurality of holes 14.

The locking cam member 30 is another one of the principal components of the apparatus of the present invention, and is shown in FIG. 3. It will be seen that the locking cam member has an ovoid configuration, with a narrow end 32 and a broad end 34. The locking cam member 30 has a camming surface 36 at the broad end 34, and it also has a pivot axis 38 near the narrow end 32. Thus, just like the force application member 20, the locking cam member 30 is adapted so as to be removably and pivotally mounted on the base plate 12, with the locking cam member pivot axis 38 being aligned with one of the plurality of holes 14, as described hereafter.

There are at least two pins which are provided, and they are shown in each of FIGS. 4 through 11 at 42 and 44, respectively. In general, at least four pins will be employed; however, as discussed hereafter, the third and four pins might be an integral part of the force application member 20 and the locking cam member 30, respectively. More usually, however, additional pins are employed for mounting the force application member and the locking cam member 30 on the base plate 12, as described hereafter.

Each of the locking cam member 30 and the force application member 20 is provided with a handle member 52 and 54, respectively. Each ofthe handle members 52 and 54 is utilized to effect pivotal movement of the respective locking cam member 30 and force application member 20 about their respective pivot axes 38 and 28, respectively.

The function of the apparatus of the present invention, and the operation of the method in keeping with the present invention, will now be described:

First, it will be noted that a workpiece, which comprises a rod or bar of malleable metal material, is to be bent. Typically, the malleable metal rod may be, as noted above, mild steel or other steel formulation which is malleable, rebar, wrought iron, brass, aluminum, copper, or surgical steel. The aforementioned list of malleable metal rods is representative only, and is not exhaustive. Moreover, it will be understood that a plurality of bends may be placed in any given workpiece with almost unlimited placement of each bend.

The workpiece 60 is placed on the base plate 12, against the two pins 42 and 44 which are placed in spaced apart holes. In FIGS. 4 through 11, the pins 42 and 44 are shown being placed in holes which are in the same row, but they need not necessarily be so placed. The locking cam member 30 is placed on the base plate 12 in a location which is more or less midway between the pins 42 and 44. The hole location at which the locking cam member 30 is pivotally mounted is shown at 70. The position 70 is chosen so that, when the handle member 52 is manipulated, the camming surface 36 of the locking cam member 30 will be forced against the side of the workpiece 60 which is remote from the pins 42 and 44. Thus, manipulation of the handle 52 will result in the workpiece being locked in place because it is forced against the pins 42 and 44 by the action of the camming surface 36 against the side of the workpiece which is remote from the pins 42 and 44. There may be a slight curvature which is formed temporarily in the workpiece 60, but the elastic memory of the workpiece 60 will be such that it will resume its straight configuration in the region between the pins 42 and 44 when the force against it is released by further manipulation of the handle 52 to release the camming surface 36 away from the workpiece 60.

As shown in FIGS. 5 through 11, the force application member 20 will be located on the base plate 12 so that the force applying surface 26 is at a region of the workpiece 60 which is near one of the two spaced apart pins—in this case, pin 44—and the force applying surface 26 is also located against the workpiece 60 in a region thereof which is remote from the other of the two spaced apart pins. Thus, the force applying surface 26 contacts the workpiece 60 at the side of pin 44 which is remote from pin 42. Then, by manipulation of the handle member 54, bending force will be transferred from the force application member 20 to the workpiece 60 through the force applying surface 26.

Figure 5:
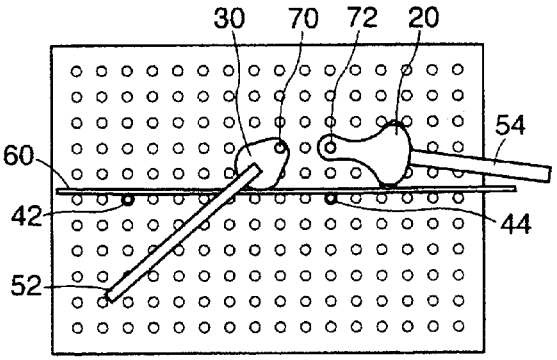
Figure 6:
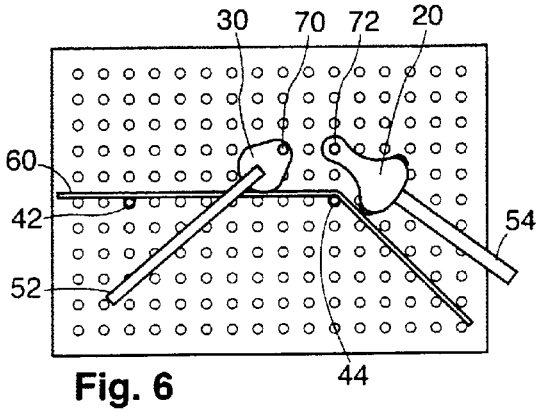

It will be noted in FIGS. 5 and 6 that the force application member 20 is positioned in a first position with hole location 72 being chosen. The hole position 72 is chosen so that the initial contact of the force applying surface 26 of the force application member 20 will be as described above, and as illustrated in FIGS. 5 and 6.

Figure 7:
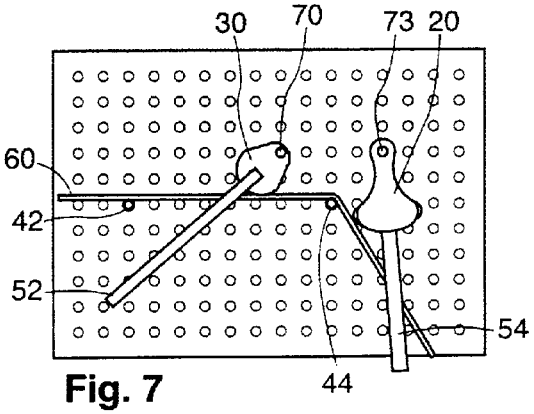
Figure 8:
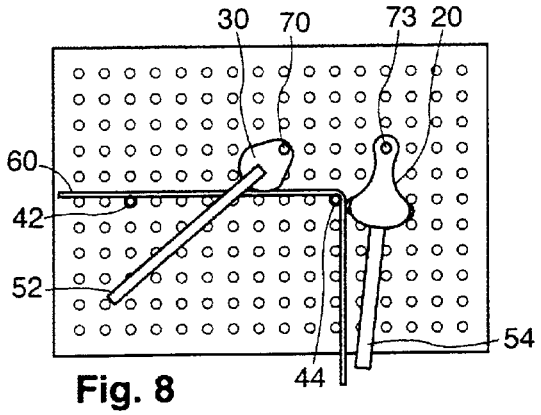
Figure 9:
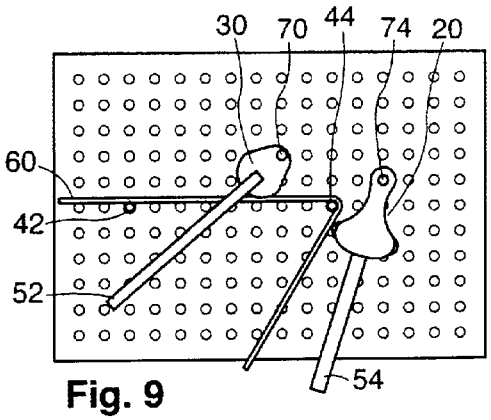

However, as the bending of the rod progresses, it may be necessary to move the force application member 20 to a different location. This is shown in FIGS. 7, 8, and 9, where the force application member 20 is shown being located at hole location 73. In this location, it is seen that a better or more efficacious force transmission from the force application member to the workpiece 60 may be effected, as the workpiece continues to be bent.

Figure 10:
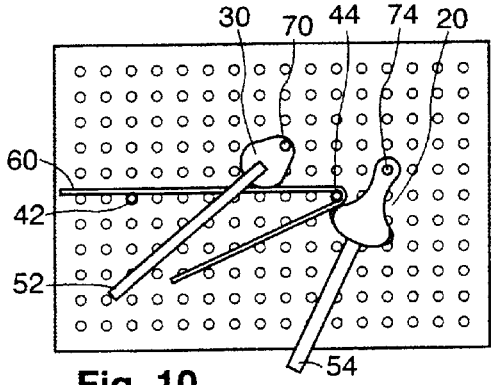
Figure 11:
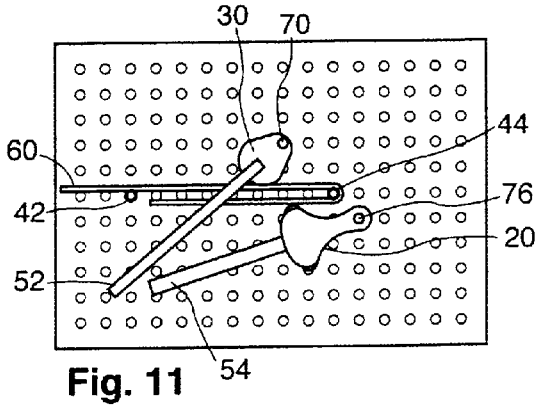

Moreover, if the workpiece is to be bent through essentially 180°, to adopt the configuration shown in FIG. 11, it may be necessary to move the force application member 20 to one or two further locations, such as hole locations 74 and 76 shown in FIGS. 10 and 11, respectively. It will also be noted that the curved sides 23 of the force application member 20 permit the portion of the workpiece 60 where it is being bent around the pin 44 to extend into the curve, thereby accommodating a larger rotation of the force application member 20 than might otherwise have been possible.

From the above, the method of the present invention becomes clear. Step (a) comprises locking the workpiece 60 on the base plate 12 by placing the two pins 42 and 44 in spaced apart holes, and placing the workpiece 60 against the two pins 42 and 44. The locking cam member 30 is placed at the side of the workpiece 60 which is remote from the two spaced apart pins 42 and 44, and the handle member 52 of the locking cam member 30 is manipulated so as to force the camming surface 36 thereof against the workpiece 60. This, in turn, forces the workpiece 60 against the two spaced apart pins 42 and 44, and thereby locks the workpiece 60 in place.

Step (b) is carried out by placing the force application member 20 on the base plate 12 so that the force applying surface 26 contacts the workpiece 60 in a region near the pin 44 and at the side of the pin 44 which is remote from the pin 42. This condition applies in respect of the placement of the force application member 20 as it is shown in any of FIGS. 5 through 11.

Step (c) is then conducted by pivotally moving the force application member 20 about its respective pivot axis 28 by manipulation of its handle member 54, so as to transfer bending force from the force application member to the workpiece 60 through the force applying surface 26.

As noted, steps (b) and (c) of the present invention may be repeated more than once, with the force application member 20 being placed at different locations on the base plate 20 for each iteration of steps (b) and (c). This is particularly noted in FIGS. 5 and 6, 7 through 9, FIG. 10, and FIG. 11, where the force application member 20 is shown being mounted at four different hole locations.

It should be noted that the pins 42 and 44 may have one or another of different configurations. For example, the pins 42 and 44, and other pins which are employed particularly for purposes of mounting the force application member 20 and the locking cam member, in the manner described hereafter, will have a constant diameter throughout their length. The constant diameter of such pins is substantially equal to the diameter of each of the plurality of holes 14. Thus, the pins fit into the holes 14 with a reasonably snug fit, and are not loosely placed therein.

Another embodiment of the pins may be that they have a diameter at one end which is substantially equal to the diameter of each of the plurality of holes 14 - once again, so as to have a reasonably snug fit in the hole - but such pins have a second selected diameter at the other end which is usually greater - but may be less - than the diameter of each of the plurality of holes. Those pins, which present a larger or smaller diameter above the upper surface of the base plate 12, may be employed for a variety of reasons. For example, larger pins may be employed when the cross dimension of the workpiece 60 is small, so as to ensure that the workpiece 60 will be locked in place by manipulation of the locking cam member 30 to force the camming surface 36 against the workpiece. Also, if a pin having a larger diameter in its upper region is employed particularly as pin 44, it presents a mandrel about which the workpiece 60 will be bent, which mandrel has a larger diameter than otherwise. Alternatively, a pin having a smaller diameter in its upper region may be employed, to present a smaller mandrel than otherwise. Accordingly, the sharpness of the bend which is formed in the workpiece 60 may be controlled by appropriate selection of at least the one pin which will be in close proximity to the location of the force application member 20.

Typically, any pins which are employed are case-hardened. It will be seen from an inspection of any of FIGS. 4 though 11, especially FIGS. 5 through 11, that considerable force may be applied against the pins 42 and 44—and against the pins which mount the force application member 20 and the locking cam member 30 on the base plate 12. That force, which is exerted against the pins, could cause them to bend, if they were not formed from case-hardened steel. Accordingly, the likelihood of failure of the pins is that they will probably shear rather than bend.

In a typical embodiment of the present invention, each of the force application member 20 and the locking cam member 30 is pivotally mounted on the base plate 12 by a respective further pin which is adapted to be received by any one of the plurality of holes 14. That pin may be formed in and become an integral part of the force application member 20 and the locking cam member 30; in which case, each of the force application member 20 and the locking cam member 30 may be mounted on the base plate 12 in a single, face-up orientation.

On the other hand, a pivot axis hole 25 and 35 may be formed in each of the force application member 20 and the locking cam member 30, respectively, in the region of the pivot axes 28 and 38, respectively. Thus, a pin, such as pins 42 and 44—in any event, usually a pin which has a constant diameter throughout its length—may be received in the respective pivot axis holes 25 and 35, and in any one of the holes 14. Usually, a pin is placed in the selected hole 14, and then the force application member 20 or the locking cam member 30 is placed over that pin so as to pivotally mount the force application member 20 or locking cam member 30 on the base plate 12. Accordingly, each of the force application member 20 and the locking cam member 30 is typically formed having symmetry about its longitudinal axis, so that they may be mounted in a face-up or face-down orientation.

In a particular embodiment of the present invention, there is a cylindrical force transfer member 27 which is rotatably mounted at each side of the broad end 24 of the force application member 20. Thus, the cylindrical force transfer members 27 will each comprise a respective force applying surface 26 at either side of the force application member 20.

In such an embodiment as described immediately above, it is usual that the cylindrical force transfer member 27 is mounted on a friction bearing 29. This is in contradistinction to the prior art, where cylindrical force transfer members, when employed, are freely rotatable. The Inventor herein has unexpectedly discovered that, if the cylindrical force transfer members 27 are mounted on a friction bearing member, there is less slippage and better force transfer to the workpiece.

So as to provide for easy manipulation of the locking cam member 30, and so as to allow for its placement on the base surface 12 in either a face-up or face-down orientation, a polygonal hole 39 may be formed through the thickness of the locking cam member 30. Typically, the polygonal hole is hexagonal. The purpose of the polygonal hole is to mate to a pin member (not shown), which is mounted on the handle member 52 for the locking cam member 30. Thus, the handle member 52 for the locking cam member 30 will overlie the workpiece 60, and the workpiece 60 will not interfere with the handle member 52.

It will be obvious that the spacing of the respective rows and columns of the holes 14, together with the diameter of the pins which are to be fitted in the holes, will be determinative of the size of malleable metal rod which may be bent as the workpiece for the apparatus in keeping with the present invention. Thus, an apparatus in keeping with the present invention may be specifically designed, for example, for use with rebar, which typically has a diameter ranging from one centimeter to 2.5 centimeters. On the other hand, a similar apparatus may be dimensioned and provided for use with surgical steel rod, which may typically have a diameter of two millimeters to five millimeters.

It will be evident that apparatus in keeping with the present invention can be further equipped with a suitable clamping or hold-down means, whereby the apparatus can be placed on the tailgate of a truck at a job site, or on a workbench.

It will be evident from the above that multiple bends may be made in any workpiece, simply by unlocking the workpiece 60 and repositioning it so that the region of the workpiece 60 where the next bend is to be made is adjacent the pin where the force application member 20 is to be mounted in the examples discussed above, pin 44. Of course, it may be necessary to reposition the pins 42 and 44 in different holes 14 than where they were positioned previously, so long as the workpiece may be locked against the pins 42 and 44. The bend or bends to be imparted in any workpiece may range from a few degrees up to 180°, by simple re-adjustment of the positioning of the force application member 20.

The general purpose for apparatus in keeping with the present invention is to bend solid rod or bar of malleable metal such as mild steel, wrought iron, aluminum, brass, copper, surgical steel, etc. However, it is possible that the apparatus of the present invention may be employed for bending hollow tube or pipe. In that case, the hollow tube or pipe must first be filled with a material such as sand, and then capped at both ends, before any bending operation is conducted. Otherwise, the wall of the tube or pipe will likely collapse or accordion at the inner side the bend.

It will also be evident that considerable bending force may be transmitted to the workpiece. For example, the distance from the force application member pivot axis 28 to the force application surface 26 may be about ten centimeters, whereas the length of the handle member 54 may be as much as sixty to 100 centimeters. Thus, there may be force multiplier of 6 to 10 for the bending force applied to the workpiece with respect to the force applied to the handle.

There has been described an apparatus for bending malleable metal rods, and a method for doing so; and the principal components and steps of the apparatus and method have been discussed in some detail. It is evident, however, that other embodiments of the present invention may be employed without departing from the spirit and scope of the appended claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., when used with the word "equal", it is intended to mean equality, nearly equal and/or exhibiting characteristics associated with an equal element.

What is claimed is:

1. An apparatus for bending malleable metal rods, said apparatus comprising:

a base plate having a plurality of holes formed therein, said holes being arranged in rows and columns;

a locking cam member having an ovoid configuration with a narrow end and a broad end, said locking cam member having a camming surface at said broad end and a locking cam member pivot axis near said narrow end, said locking cam member being adapted so as to be removably and pivotally mounted on said base plate, with said locking cam member pivot axis being aligned with one of said plurality of holes;

a force application member having a narrow end and a broad end, said force application member having at least one force applying surface at one side of the broad end thereof and a force application member pivot axis near said narrow end, said force application member being adapted so as to be removably and pivotally mounted on said base plate, with said force application member pivot axis being aligned with one of said plurality of holes; and at least two pins adapted to be received in any two of said plurality of holes;

wherein each of said locking cam member and said force application member has a handle member for effecting pivotal movement of each said member about its respective pivot axis;

whereby a workpiece of malleable metal rod may be locked in place by being forced against two pins when they are received in two spaced apart holes, and said camming surface of said locking cam member is forced against the side of said workpiece remote from the side thereof which contacts said two spaced apart pins; and whereby a workpiece may be bent by contacting the workpiece with said force applying surface of said force application member at a region of the workpiece which is near one of said two spaced apart pins but which is remote from the other of said spaced apart pins, and by causing pivotal movement of said force application member about its respective pivot axis by manipulation of the handle member thereof, so as to transfer bending force from said force application member to the workpiece through said force applying surface.

2. The apparatus of claim 1 for bending malleable metal rods, wherein each of said at least two pins has a constant diameter throughout its length, and said constant diameter is substantially equal to the diameter of each of said plurality of holes.

3. The apparatus of claim 1 for bending malleable metal rods, wherein at least some of said at least two pins have a diameter at one end thereof which is substantially equal to the diameter of each of said plurality of holes, and a second selected diameter at the other end thereof which is greater or less than the diameter of each of said plurality of holes.

4. The apparatus of claim 1 for bending malleable metal rods, wherein each of said locking cam member and said force application member is pivotally mounted on said base plate by a respective further pin means which is adapted to be received by any one of said plurality of holes.

5. The apparatus of claim 4 for bending malleable metal rods, wherein a pivot axis hole is formed in each of said locking cam member and said force application member in the region of the respective pivot axis of each said member, so that a respective further pin means for each said member may be received in any one of said plurality of holes and in said respective pivot axis hole.

6. The apparatus of claim 1 for bending malleable metal rods, wherein there is a force applying surface located at each side of the broad end of said force application member.

7. The apparatus of claim 6 for bending malleable metal rods, wherein a cylindrical force transfer member is rotatably mounted at each side of said broad end of said force application member so as to comprise each respective force applying surface.

8. The apparatus of claim 7 for bending malleable metal rods, wherein each of said cylindrical force transfer members is rotatably mounted on a respective friction bearing member.

9. The apparatus of claim 1 for bending malleable metal rods, wherein said locking cam member has a polygonal hole formed therein to receive a polygonal pin member, wherein said polygonal pin member is mounted on said handle member for said locking cam member.

10. The apparatus of claim 1 for bending malleable metal rods, wherein said at least two pins are formed of case-hardened steel.

11. A method for bending a workpiece which comprises a malleable metal rod using an apparatus therefor, said apparatus comprising:

a base plate having a plurality of holes formed therein, said holes being arranged in rows and columns;

a locking cam member having an ovoid configuration with a narrow end and a broad end, said locking cam member having a camming surface at said broad end and a locking cam member pivot axis near said narrow end, said locking cam member being adapted so as to be removably and pivotally mounted on said base plate, with said locking cam member pivot axis being aligned with one of said plurality of holes;

a force application member having a narrow end and a broad end, said force application member having at least one force applying surface at one side of the broad end thereof and a force application member pivot axis near said narrow end, said force application member being adapted so as to be removably and pivotally mounted on said base plate, with said force application member pivot axis being aligned with one of said plurality of holes; and at least two pins adapted to be received in any two of said plurality of holes;

wherein each of said locking cam member and said force application member has a handle member for effecting pivotal movement of each said member about its respective pivot axis;

said method comprising the steps of:

(a) locking the workpiece in place on said base plate by placing two pins in spaced apart holes, placing said workpiece against said two pins and placing said locking cam member at the side of said workpiece remote from said two spaced apart pins, and manipulating the handle member of said locking arm member so as to force the camming surface thereof against said workpiece so as to force said workpiece against said two spaced apart pins and so as to thereby lock said workpiece in place;

(b) placing said force application member on said base plate so that said force applying surface contacts said workpiece in a region near one of said two spaced apart pins and at the side thereof remote from the other of said spaced apart pins; and (c) pivotally moving said force application member about its respective axis by manipulation of the handle member thereof so as to transfer bending force from said force application member to said workpiece through said force applying surface of said force application member.

12. The method of claim 11, wherein steps (b) and (c) may be repeated more than once, with said force application member being placed at different locations on said base plate for each iteration thereof.

13. The method of claim 11, wherein each of said at least two pins has a constant diameter throughout its length, and said constant diameter is substantially equal to the diameter of each of said plurality of holes.

14. The method of claim 11, wherein at least some of said at least two pins have a diameter at one end thereof which is substantially equal to the diameter of each of said plurality of holes, and a second selected diameter at the other end thereof which is greater or less than the diameter of each of said plurality of holes.

15. The method of claim 11, wherein each of said locking cam member and said force application member is pivotally mounted on said base plate by a respective further pin means which is adapted to be received by any one of said plurality of holes.

16. The method of claim 15, wherein a pivot axis hole is formed in each of said locking cam member and said force application member in the region of the respective pivot axis of each said member, so that a respective further pin means for each said member may be received in any one of said plurality of holes and in said respective pivot axis hole.

17. The method of claim 11, wherein there is a force applying surface located at each side of the broad end of said force application member.

18. The method of claim 17, wherein a cylindrical force transfer member is rotatably mounted at each side of said broad end of said force application member so as to comprise each respective force applying surface.

19. The method of claim 18, wherein each of said cylindrical force transfer members is rotatably mounted on a respective friction bearing member.

20. The method of claim 11, wherein said workpiece is chosen from the group consisting of round mild steel rod, rectangular mild steel rod, rebar, round wrought iron rod, rectangular wrought iron rod, round brass rod, rectangular brass rod, round aluminum rod, rectangular aluminum rod, round copper rod, rectangular copper rod, and surgical steel rod.

* * * * *